US008245358B2

(12) United States Patent
Lo

(10) Patent No.: US 8,245,358 B2
(45) Date of Patent: Aug. 21, 2012

(54) PACIFIER CLIP

(75) Inventor: Chin-Tien Lo, Taoyuan Hsien (TW)

(73) Assignee: Tien Chung Ent. Co., Ltd., Taoyuan Hsien (TW)

( * ) Notice: Subject to any disclaimer, the term of this patent is extended or adjusted under 35 U.S.C. 154(b) by 1 day.

(21) Appl. No.: 12/854,801

(22) Filed: Aug. 11, 2010

(65) Prior Publication Data

US 2012/0036682 A1 Feb. 16, 2012

(51) Int. Cl.
*A44B 6/00* (2006.01)

(52) U.S. Cl. ..... 24/3.13; 24/499; 24/516; 24/504; 606/234

(58) Field of Classification Search ..... 24/3.13, 24/504, 499, 516; 606/234, 235, 236
See application file for complete search history.

(56) References Cited

U.S. PATENT DOCUMENTS 1,922,594 A * 8/1933 Lippstadt ..... 24/3.13
5,778,497 A * 7/1998 Noda ..... 24/504
6,243,921 B1 * 6/2001 Chang ..... 24/3.13
6,260,244 B1 * 7/2001 Noda ..... 24/499
6,263,702 B1 * 7/2001 Lo ..... 63/1.11
6,327,757 B1 * 12/2001 Noda ..... 24/504
7,979,965 B2 * 7/2011 Lo ..... 24/504

* cited by examiner

*Primary Examiner* — Robert J Sandy
*Assistant Examiner* — Michael Lee
(74) *Attorney, Agent, or Firm* — Guice Patents PLLC

(57) ABSTRACT

The present invention relates to a pacifier clip, consists of a base board, a pulling sheet, a mobile clipping sheet and a connection tool. When the pulling sheet is pulled, through the leverage effect the swivel rod optionally abuts against the bottoms of the support arms or swivels the passive sheet while the swivel rod is rotated, so the mobile end of the mobile clipping sheet generates an upward or downward movement, and the teeth lines of the mobile end and the teeth rows of the base board are engaged or forms a slit. When the mobile clipping sheet of the pacifier clip is clipped on a thicker object, through the leverage effect, the pair of support arms of the mobile clipping sheet applies a clockwise force to the swivel rod disposed below the support arms, so the abutting force between the two components is enhanced and the clipping effect is also increased.

10 Claims, 5 Drawing Sheets

PACIFIER CLIP

BACKGROUND OF THE INVENTION

1. Field of the Invention

The present invention relates to a pacifier clip, especially to a safe pacifier clip capable of firmly clipping and easy to operate and complying with safety regulations issued by various countries.

2. Description of Related Art

When an infant sucks a pacifier, a comforting feeling is provided to him/her. Especially before an infant fall asleep, he/she may cry or even grumpy, he/she often needs a pacifier for a good night sleep. However, the pacifier is often lost while the infant is playing games or doing other things, so when he/she wants to have the pacifier to suck but the pacifier is nowhere to be found, he/she may cry and angry, and the adults who take care of the infant may have some problems or troubles for comforting the infant. So people skilled in the arts have developed many pacifier clips having different shapes and styles, for clipping a pacifier on an infant's clothes, so the lost of pacifier is avoided.

The Taiwan Utility Model Publication No. 385641, titled "Improved structure of ornament" (corresponding to the China Utility Model Patent No. 99208854.2), issued to the applicant of this invention has disclosed an ornament having a clipping function and suitable to be used as a pacifier clip; said ornament consists of a board, a pulling sheet and a mobile clipping sheet. The back of the board is protrudingly installed with a pair of board wings, and pivot ends of the pulling sheet and the mobile clipping sheet, which are in a staggering status, are pivoted to the pair of board wings; such that a pair of tenon rods radialy and protrudingly installed at the pivot end of the pulling sheet is adjacent to an inner wall of an L-shaped sheet hook of the mobile clipping sheet. When the pulling sheet is counterclockwise and upwardly pulled, the tenon rods synchronously rotate along the inner wall of the L-shaped sheet hook so as to be received in a rod cavity, which is in a concave status, disposed at the inner bottom wall of the sheet hook, and a mobile end of the mobile clipping sheet is clockwise and upwardly raised, so a slit is formed between teeth lines protrudingly installed at the inner wall of the mobile end and teeth rows preset on the back of the board, thus the ornament is able to be separated from clothes.

When the ornament is desired to be clipped on a clothes, the slit defined between the mobile clipping sheet and the board is sleeved in the edge of the clothes, then the pulling sheet is clockwise and downwardly pressed, such that the tenon rods are synchronously rotated and released from the rod cavity till being abutted against the lateral wall of the sheet hook, at this moment the sheet hook is no longer supported by the tenon rods, and the mobile end of the mobile clipping sheet is counterclockwise and downwardly moved, the teeth lines and the teeth rows are engaged with each other, thus the ornament is able to be clipped on the clothes.

The disclosed patent can overcome many disadvantages of conventional pacifier clips, but one obvious disadvantage thereof is that when the ornament is in a clipped status, the tenon rods of the pulling sheet are directly abutted against the lateral wall of the sheet hook and there is no positioning structure between the mentioned two components, so when the mobile end of the mobile clipping sheet is clipped on a thicker clothes, the lateral wall of the sheet hook would slightly and clockwise rotate and may further cause the tenon rods to loosen.

SUMMARY OF THE INVENTION

One primary object of the present invention is to provide a pacifier clip capable of firmly clipping and easily releasing; when a mobile clipping sheet of said pacifier clip is clipped on a thicker object, e.g. clothes, through the leverage effect of a pair of support arms of the mobile clipping sheet, the pair of support arms applies a clockwise force to a swivel rod disposed below the support arms, so the abutting force between the two components is enhanced and the clipping effect is also increased For achieving the mentioned object, one solution provided by the present invention is to provide a pacifier clip, comprises:

a base board, the back thereof is protrudingly installed with a pair of board walls, the fronts of the two board walls are respectively installed with a pivot part, the rears thereof are protrudingly provided with one or more teeth rows;

a pulling sheet, shaft connecting parts installed at the rear are pivoted to the pivot parts, the shaft connecting parts are radialy extended with a swivel rod, the center of the swivel rod is frontally extended with a neck part, the neck part is connected to the bottom of the pulling sheet;

a mobile clipping sheet, shaft connecting parts installed at the front are pivoted to the pivot parts, the shaft connecting parts are frontally extended with a pair of support arms, bottoms of the two support arms are disposed adjacent to the swivel rod, and the rears of the bottoms are longitudinally extended with a passive sheet, a neck slot is formed between the two support arms for receiving the neck part, a mobile end at the rear of the mobile clipping sheet is provided with one or more teeth lines corresponding to the locations where the teeth rows are installed; and an elongated connection tool, one end thereof is fastened on the base board, the other end thereof is connected with a connecting part;

when the pulling sheet is pulled, through the leverage effect the swivel rod optionally abuts against the bottoms of the support arms or swivels the passive sheet while the swivel rod is rotated, so the mobile end of the mobile clipping sheet generates an upward or downward motion, such that the teeth lines of the mobile end and the teeth rows of the base board are engaged or forms a slit.

DETAILED DESCRIPTION OF THE PREFERRED EMBODIMENT

Figure 1:
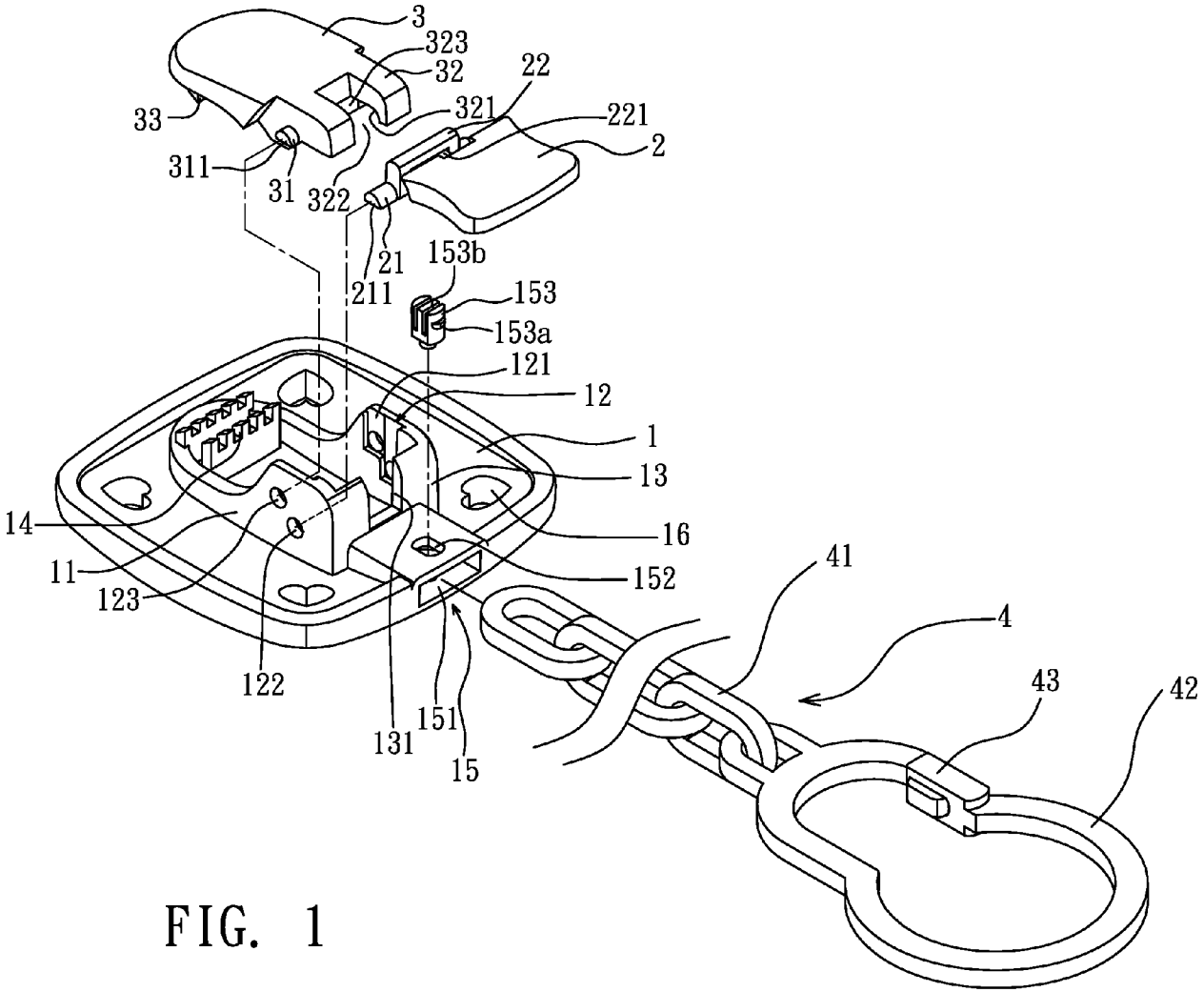
FIG. 1 is a perspective exploded view of the pacifier clip of the present invention.
Figure 2:
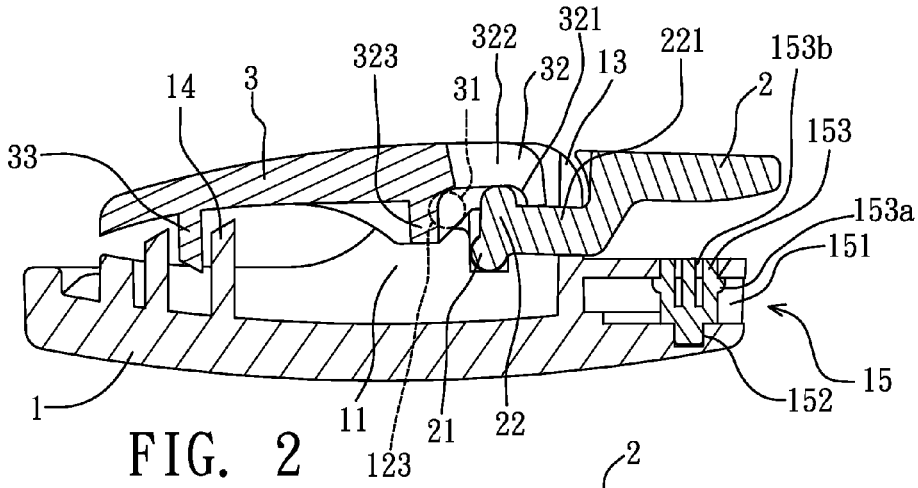
FIG. 2 to FIG. 4 are cross sectional views illustrating the assembled pacifier clip of the present invention being in a clipped status then adjusted to a released status.
Figure 3:
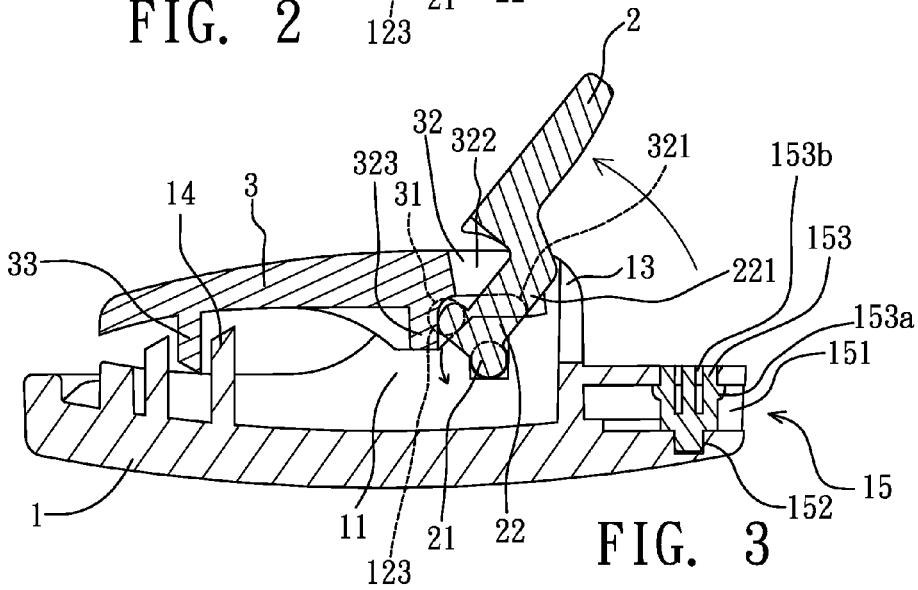
Figure 4:
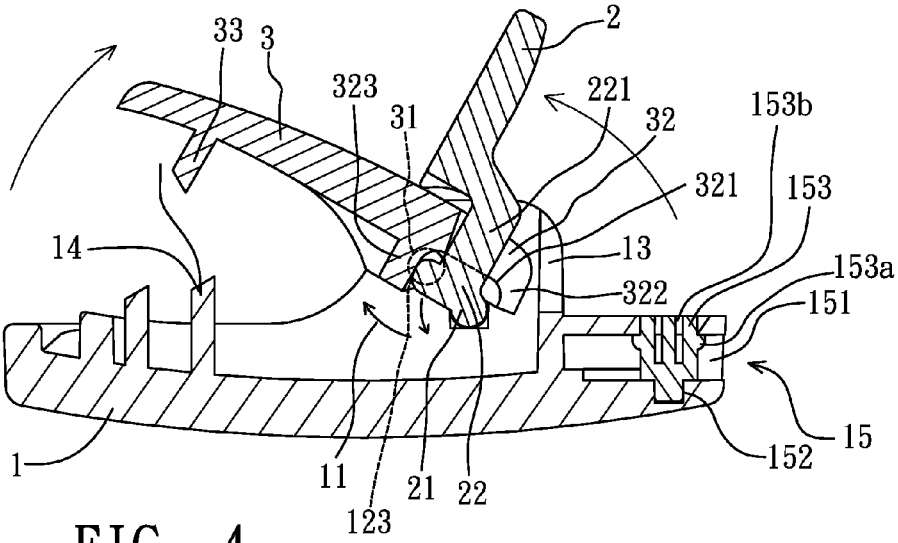
Figure 5:
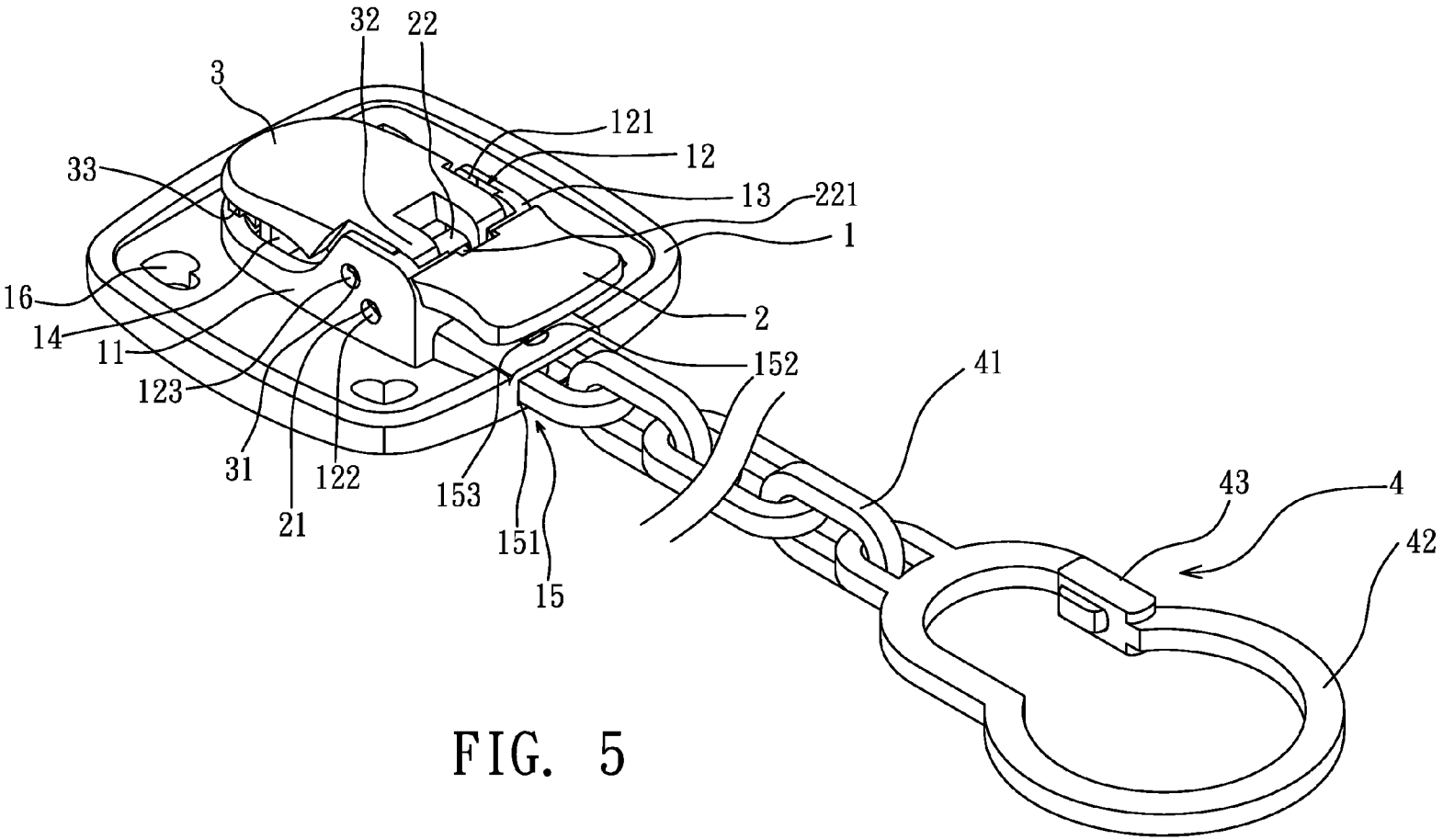
FIG. 5 is a perspective view of the pacifier clip of the present invention being in a clipped status.
Figure 6:
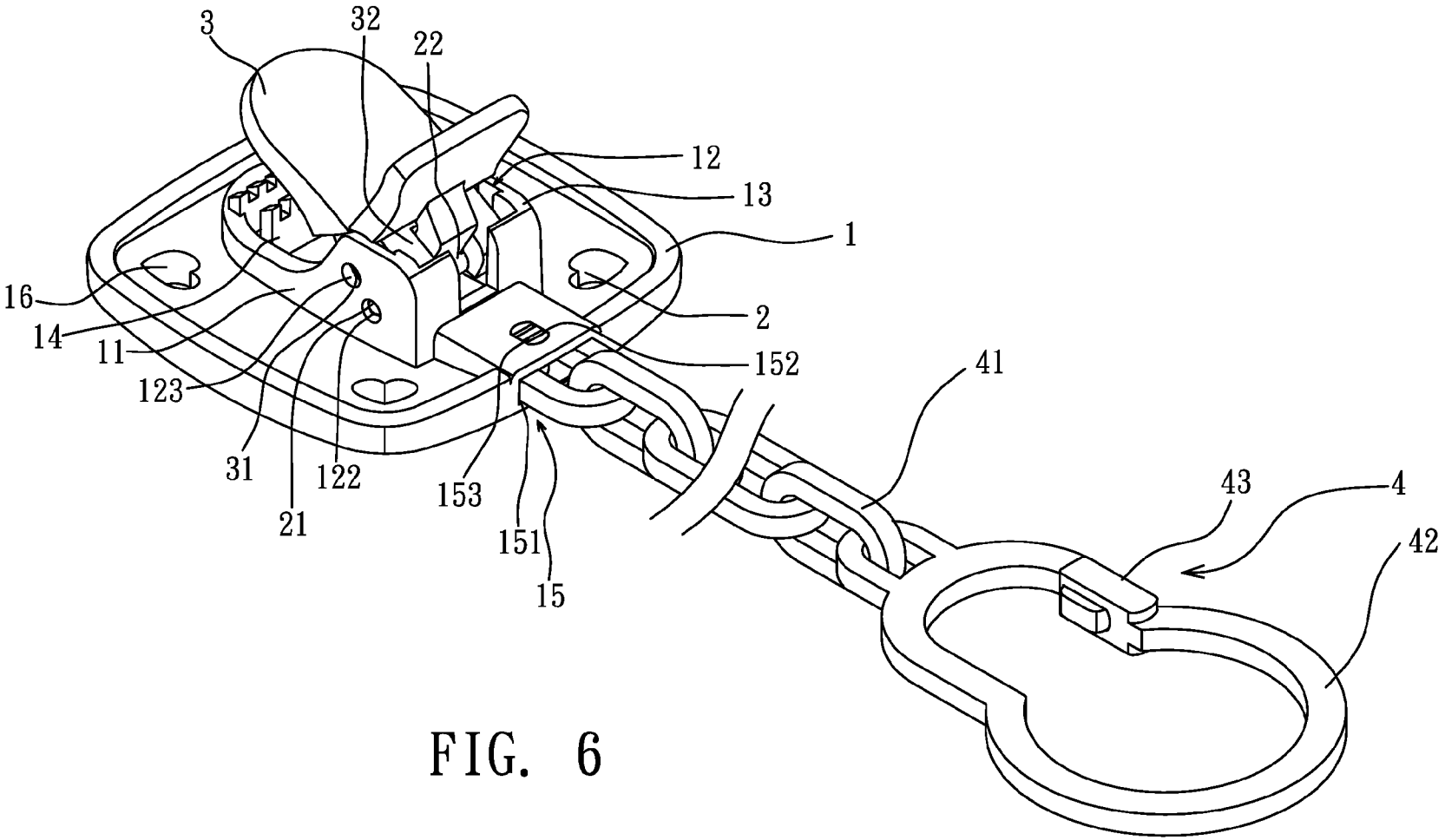
FIG. 6 is a perspective view of the pacifier clip of the present invention being in a released status.
Figure 7:
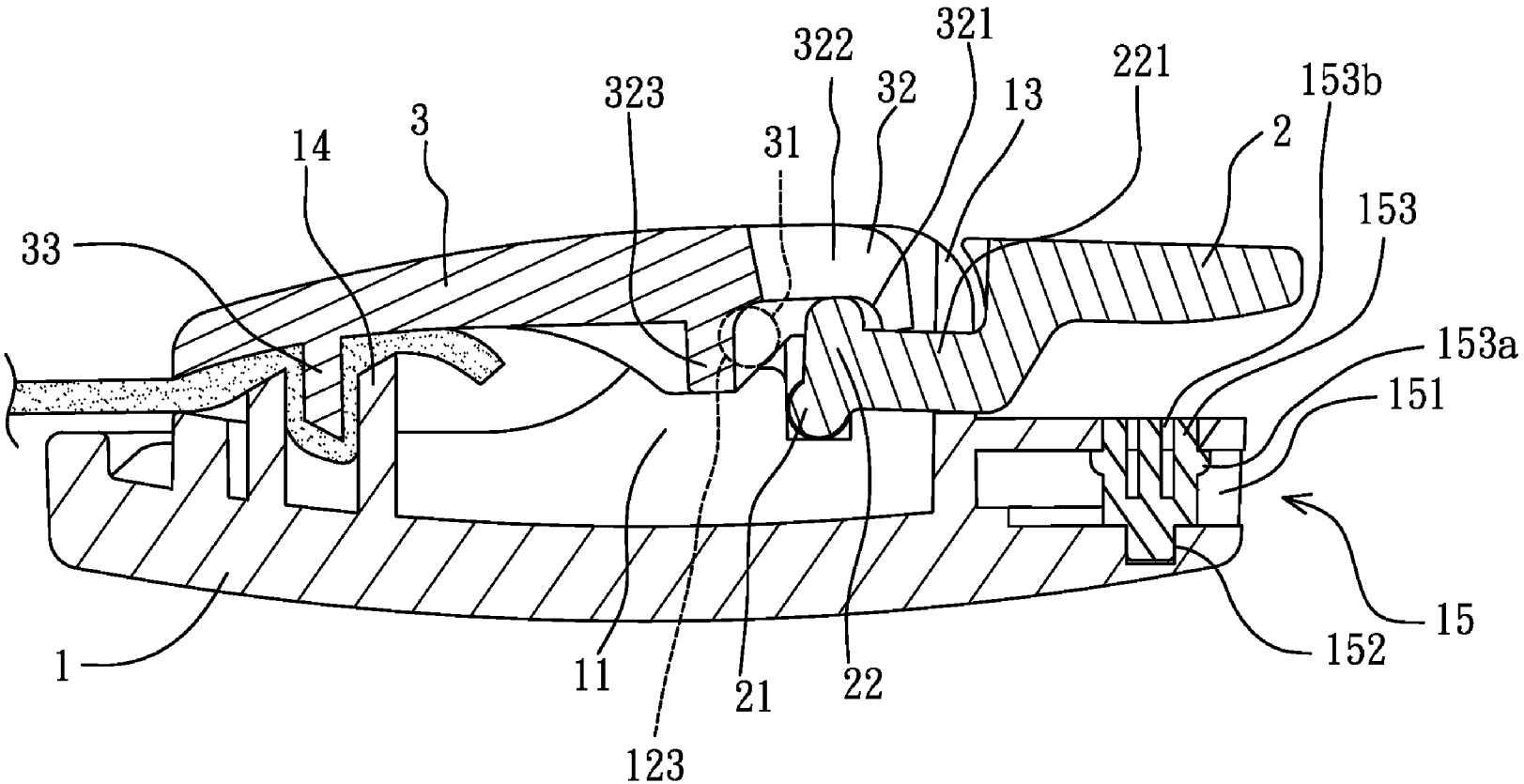
FIG. 7 is a cross sectional view illustrating the pacifier clip of the present invention being clipped on a thicker object.

For further disclose the present invention, figures assisting the disclosure of this invention are provided, in which FIG. 1 is a perspective exploded view of the pacifier clip of the present invention; FIG. 2 to FIG. 4 are cross sectional views illustrating the assembled pacifier clip of the present invention being in a clipped status then adjusted to a released status; FIG. 5 is a perspective view of the pacifier clip of the present invention being in a clipped status; FIG. 6 is a perspective view of the pacifier clip of the present invention being in a released status; FIG. 7 is a cross sectional view illustrating the pacifier clip of the present invention being clipped on a thicker object.

Referring from FIG. 1 to FIG. 6, the pacifier clip provided by the present invention mainly consists of a base board 1, a pulling sheet 2, a mobile clipping sheet 3, and a connection tool 4.

The base board 1 is an integrally-formed sheet-shaped member having various shapes, e.g. basic geometrical shapes or doll-like shapes, for a purpose of enhancing the viewing sensation. As shown in FIG. 1, the base board 1 is in a rectangular shape and able to be provided with two-dimensional patterns through printing or laminating or provided with three-dimensional ornaments through adhering; or a decorative sheet is connected to the front of the base board 1, wherein the decorative sheet has the same size and shape as the base board 1, and the surface of the decorative sheet is able to be provided with two-dimensional patterns through printing or laminating or provided with three-dimensional ornaments through adhering for enhancing the outlook and increasing the purchase willingness of consumers.

The back of the base board 1 is protrudingly installed with a pair of board walls 11, the fronts of the two board walls 11 are respectively connected with a pivot part 12, a pair of contact slots 121 is provided to the pivot parts 12 on opposite inner walls of the two board walls 11. The concave slots 121 are symmetrically installed with a pair of first shaft holes 122 and a pair of second shaft holes 123 having different height with respect to the pair of first shaft holes 122, such that pivot ends of the pulling sheet 2 and the mobile clipping sheet 3 can be pivoted. The outer ends of the pivot parts 12 of the two board walls 11 are respectively formed with a fastening wall 13, wherein the center defined by the two fastening walls 13 is formed with a notch 131 that allows a neck part 221 of the pulling sheet 2 to pass through. Moreover, the rears of the two board walls 11 are installed with one or more teeth rows 14.

A proper position of the base board 1, e.g. a distal edge close to the pivot parts 12, is installed with a connecting part 15 for being connected with the connection tool 4. As shown in FIG. 1, an accommodating slot 151 is transversally installed in the connecting part 15 for accommodating a ring 42 arrange at the tail end of the connection tool 4; the top and bottom of the accommodating slot 151 are longitudinally installed with an insertion hole 152 having a non-circular cross section, such that when an insertion pin 153 is inserted in the insertion holes 152 for a purpose of fastening, the insertion pin 153 also passes through the ring 42 of the connection tool 4, thus a connection is formed between the base board 1 and the connection tool 4. The front and rear of the insertion pin 153 are protrudingly installed with a pair of wedge-shaped stop 153*a*, and longitudinally installed with at least one resilient slot 153*b*, so two lateral sides of the insertion pin 153 are provide with elasticity, so when being inserted in the insertion holes 152, the pair of stops 153*a* are expanded and abutted against the inner walls of the insertion holes 152, so the insertion pin 153 is preventing from separating from the connecting part 15.

Further more, a proper position of the base board 1, e.g. the periphery of the board walls 11, is formed with at lease one air permeable hole 16, so when an infant accidentally swallows the pacifier clip, the suffocation can be avoided and the rescue time is prolonged.

The pulling sheet 2 is a multi-bending shaped sheet member; the rear thereof is installed with shaft connecting parts 21, e.g. guiding oblique surfaces 211 at two lateral sides of a shaft rod, can slide into the first shaft holes 122 along the concave slots 121 so as to form a swing motion. The shaft connecting parts 21 are radially extended with a swivel rod 22, the center of the swivel rod 22 is frontally extended with a neck part 221, the neck part 221 is accommodated in the mentioned notch 131, and the neck part 221 is connected to one end of the bottom of the pulling sheet 2, so as to be processed with downward pressing or upward pulling operations.

The mobile clipping sheet 3 is a sheet member, two front lateral walls are installed with shaft connecting parts 31, e.g. guiding oblique surfaces 311 of the shaft rod, sliding into the second shaft holes 123 along the concave slots 121 so as to form a swing motion. The shaft connecting parts 31 are frontally extended with a pair of support arms 32, bottoms of the two support arms 32 are respectively formed with an arm slot 321 which allows the swivel rod 22 to be received therein, and the swivel rod 22 is able to rotate along the arm slots 321. A neck slot 322 is installed between the two support arms 32 for accommodating the neck part 221, the neck slot 322 is served to allow the neck part 221 of the pulling sheet 2 to be accommodated and rotate. The rear bottoms of the two support arms 32 are longitudinally extended with a passive sheet 323 forming an interaction relation with the swivel rod 22.

Moreover, the mobile clipping sheet 3 is installed with one or more teeth lines 33 corresponding to the locations where the teeth rows 14 are installed, so as to be engaged with the teeth rows 14, or be engaged with a staggering engaging means as shown in figures of the present invention.

The connection tool 4 is an elongated member, one end thereof is fastened at the connecting part 15 preset at the periphery of the base board 1, the other end thereof can be connected to a connecting member 43, e.g. rings connected with each other and connected to a pacifier. In this embodiment of the present invention, the connection tool 4 is a chain 41, the ring 42 at the distal end thereof is connected to the connecting part 15 preset at the periphery of the base board 1, so the chain 41 is connected with the base board 1.

Referring from FIG. 2 to FIG. 5, when being assembled, the shaft connecting parts 21 of the pulling sheet 2 are pivoted in the pivot parts 12 of the pair of board walls 11 installed at the back of the base board 1, then the shaft connecting parts 31 of the mobile clipping sheet 3 are also pivoted in the pivot parts 12 of the pair of board walls 11 installed at the back of the base board 1, so the swivel rod 22 is accommodated in and abutted against the arm slots 321 of the support arms 32, and the pulling sheet 2 and the mobile clipping sheet 3 are together pivoted at the pair of board walls 11 installed at the back of the base board 1, and the teeth lines 33 installed in the inner wall of a mobile end of the mobile clipping sheet 3 are engaged with the teeth rows 14 installed at the back of the base board 1 with a staggering engaging means.

If the pacifier is desired to be released, as shown in FIG. 3, the pulling sheet 2 is counterclockwise and upwardly pulled, and the swivel rod 22 is synchronously rotated while the shaft connecting parts 21 define the first shaft holes 122 as the shaft core, so the swivel rod 22 is backwardly moved along the arm slots 321 of the support arms 32, and the latching effect is released, thus the mobile clipping sheet 3 recovers to the rotary status; when the swivel rod 22 is in contact with the passive sheet 323 disposed at the rear of the support arms 32, through the leverage effect and the shaft connecting parts 31 of the mobile clipping sheet 3 define the second shaft holes 123 as the shaft core, the mobile end of the mobile clipping sheet 3 is clockwise and upwardly rotated and raised, a larger slit is therefore formed between the teeth lines 33 and the teeth rows 14 as shown in FIG. 4 and FIG. 6. At this moment, the slit is able to be sleeved into an objected to be clipped, such as clothes.

When a clipping operation is desired to be proceeded, the slit defined between the mobile clipping sheet 3 and the base board 1 is sleeved into the object to be clipped, e.g. the edges of clothes, then the pulling sheet 2 is clockwise and downwardly pressed, so the swivel rod 22 is synchronously rotated and released from the passive sheet 323, the passive sheet 323 is no longer supported by the swivel rod 22, the mobile end at the rear is counterclockwise and downwardly moved, such that the teeth lines 33 and the teeth rows 14 are engaged and clipped on a thicker clothes, as shown in FIG. 7. Referring to FIG. 7, when the mobile clipping sheet 3 is clipped on a thicker clothes, through the leverage effect, the bottom of the pair of support arms 32 applies a clockwise force to the swivel rod 22 disposed below the support arms 32, so the abutting force between the two components are enhanced and the clipping effect is also increased, so the support arms 32 and the swivel rod 22 are preventing from loosening.

The advantages provided by the present invention are: when the pacifier clip is clipped on an object, e.g. clothes, through the leverage effect, the pair of support arms of the mobile clipping sheet applies a clockwise force to the swivel rod disposed below the support arms, so the abutting force between the two components is enhanced and the clipping effect is also increased; when the pacifier clip is in a released status, through the leverage effect, the swivel rod of the pulling sheet pulls the passive sheet of the mobile clipping sheet, so the mobile end of the mobile clipping sheet is raised, and operations of firm clipping and releasing are obtained. Moreover, the present invention does not adopt small components and does not require complicated assembly procedures, therefore assembly time and labor are saved. The present invention does not adopt any metal component and the structure thereof is firm, so the adopted components are not easy to be broken, the safety regulations issued by various country, especially the European Union are complied; and the present invention is novel compared to other products in the similar fields.

It is to be understood, however, that even though numerous characteristics and advantages of the present embodiments have been set forth in the foregoing description, together with details of the structures and functions of the embodiments, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A pacifier clip, comprising:

a base board having a pair of board walls protruding from a back surface thereof, fronts of two of said board walls being respectively installed with a pivot part, rears of said two board walls being protrudingly provided with at least one teeth row there between;

a pulling sheet, shaft connecting parts installed at a rear of said pulling sheet and being pivoted to said pivot parts, said shaft connecting parts being radially extended with a swivel rod, a center of said swivel rod being frontally extended with a neck part, said neck part being connected to a bottom of said pulling sheet, said swivel rod protruding upwardly above said shaft connecting parts of said pulling sheet, said swivel rod being located at a height above a top of said neck part and said shaft connecting parts of said pulling sheet being located at a height below a bottom of said neck part;

a mobile clipping sheet, shaft connecting parts installed at a front of said mobile clipping sheet and being pivoted to said pivot parts, said shaft connecting parts being frontally extended with a pair of support arms, bottoms of said two support arms being disposed adjacent to said swivel rod, and the rears of the bottoms of said two support arms being longitudinally extended with a passive sheet, a neck slot being formed between said two support arms for receiving said neck part, a mobile end at a rear of said mobile clipping sheet being provided at least one teeth line corresponding to the locations where said at least one teeth row is installed; and an elongated connection tool, one end thereof fastened on said base board, the other end thereof connected with a connecting part;

when said pulling sheet being pulled, through the leverage effect said swivel rod optionally abutting against the bottoms of said support arms or swiveling said passive sheet while said swivel rod being rotated, so the mobile end of said mobile clipping sheet generating an upward or downward motion, such that said teeth lines of the mobile end and said teeth rows of said base board being engaged or forming a slit;

wherein, when the pulling sheet is located in a closed position, the swivel rod is located between the bottoms of the two support arms and the back of the base board and the swivel rod engaging the bottoms of the two support arms.

2. The pacifier clip as claimed in claim 1, wherein said pivot parts are installed with a pair of concave slots on opposite inner walls of two of said board walls, said concave slots are symmetrically installed with a pair of first shaft holes having a height measured from said back surface and a pair of second shaft holes having a different height with respect to said height of said pair of first shaft holes; said shaft connecting parts of said pulling sheet and said mobile clipping sheet are shaft rods, guiding oblique surfaces at two lateral sides thereof respectively slide into said first shaft holes and said second shaft holes along said concave slots to form a swing motion.

3. The pacifier clip as claimed in claim 1, wherein the bottoms of said two support arms respectively has an arm slot that allows said swivel rod to accommodate therein, so said swivel rod is able to rotate along said arm slots.

4. The pacifier clip as claimed in claim 1, wherein outer ends of said pivot parts of said two board walls are respectively provided with a fastening wall, the center defined by said two fastening walls is formed with a notch that allows said neck part of said pulling sheet to pass through.

5. The pacifier clip as claimed in claim 1, wherein when said one or more teeth rows and teeth lines are engaged, the engagement is in a staggering engaging status.

6. The pacifier clip as claimed in claim 1, wherein a proper position of said base board is further provided with a connecting part, an accommodating slot is transversally installed in said connecting part for accommodating a tail end of said connection tool, the top and bottom of said accommodating slot are longitudinally installed with an insertion hole that allows an insertion pin to be inserted for fastening said connection tool.

7. The pacifier clip as claimed in claim 6, wherein the front and rear of said insertion pin are protrudingly installed with a pair of wedge-shaped stops, and longitudinally installed with at least one resilient slot, when said insertion pin is inserted in said insertion holes, said pair of stops are abutted against the inner walls of said insertion holes.

8. The pacifier clip as claimed in claim 1, further comprising a decorative sheet having the same size and shape as said base board, said decorative sheet is installed at a front of said base board; wherein a front of said decorative sheet is provided with a decoration selected from a group consisting of two-dimensional printed patterns, laminated patterns, three-dimensional ornaments, and a combination thereof.

9. The pacifier clip as claimed in claim 1, wherein a front of said base board is provided with a decoration selected from a group consisting of two-dimensional printed patterns, laminated patterns, three-dimensional ornaments, and a combination thereof.

10. The pacifier clip as claimed in claim 1, wherein a proper position of said base board is installed with at least one air permeable hole.

* * * * *